US009061814B2

(12) United States Patent
Copp et al.

(10) Patent No.: US 9,061,814 B2
(45) **Date of Patent: *Jun. 23, 2015**

(54) PACKAGING FOR WOUND COIL

(71) Applicant: REELEX Packaging Solutions, Inc., Patterson, NY (US)

(72) Inventors: Timothy M. Copp, Danbury, CT (US); Brian Moore, Newburgh, NY (US)

(73) Assignee: REELEX PACKAGING SOLUTIONS, INC., Patterson, NY (US)

( * ) Notice: Subject to any disclaimer, the term of this patent is extended or adjusted under 35 U.S.C. 154(b) by 78 days.

This patent is subject to a terminal disclaimer.

(21) Appl. No.: 13/950,908

(22) Filed: Jul. 25, 2013

(65) Prior Publication Data

US 2014/0326625 A1 Nov. 6, 2014

Related U.S. Application Data

(63) Continuation-in-part of application No. 13/887,502, filed on May 6, 2013.

(51) Int. Cl.
*B65D 85/04* (2006.01)
*B65D 77/04* (2006.01)
(Continued)

(52) U.S. Cl.
CPC ..... *B65D 85/04* (2013.01); *B65D 77/042* (2013.01); *B65D 5/04* (2013.01); *B65D 5/443* (2013.01); *B65D 5/4608* (2013.01); *B65D 2577/043* (2013.01); *B65D 2577/047* (2013.01)

(58) Field of Classification Search
USPC ..... 206/389, 391, 395, 396, 398, 403, 408; 229/117.12, 117.22
See application file for complete search history.

(56) References Cited

U.S. PATENT DOCUMENTS 1,463,181 A 7/1923 Vorderwinkler
1,529,816 A 3/1925 Stenglein
(Continued)

FOREIGN PATENT DOCUMENTS

DE 532861 9/1931
JP 2003182762 7/2003
KR 20100007826 8/2010

OTHER PUBLICATIONS

U.S. Appl. No. 13/506,545; Timothy M. Copp et al, filed Apr. 27, 2012; "Proflex" Shrink Bag with Handle & Handle Isolation Apparatus.

(Continued)

*Primary Examiner* — Jacob K Ackun
(74) *Attorney, Agent, or Firm* — Gordon & Jacobson, PC

(57) ABSTRACT

Packaging for a wound coil is formed from a single piece of cardboard or plastic. The packaging includes a central support having a width substantially equal to the width of the coil, first and second side elements attached to and rotatable relative to the central support and defining cutouts so that the side elements may rotate to extend over a portion of the wound coil with a portion of the side elements meeting and being fastened to each other at a location substantially half-way along the width of the coil, and a handle section with first and second handle portions attached and rotatable relative the side elements. The handle section can assume a first position defines a hand-hold, and a second position substantially parallel to the central support. With the packaging, one package and coil assembly can be stacked atop another.

12 Claims, 9 Drawing Sheets

(51) Int. Cl.

| | |
|---|---|
| ***B65D 5/04*** | (2006.01) |
| ***B65D 5/44*** | (2006.01) |
| ***B65D 5/468*** | (2006.01) |

(56) References Cited

U.S. PATENT DOCUMENTS

| | | | | | |
|---|---|---|---|---|---|
| 2,217,397 | A | * | 10/1940 | Armitt | 206/395 |
| 2,388,557 | A | | 11/1945 | Little et al. | |
| 2,459,747 | A | | 1/1949 | Kolbe | |
| 2,634,918 | A | | 4/1953 | Taylor et al. | |
| 2,634,922 | A | | 4/1953 | Taylor | |
| 2,650,036 | A | | 8/1953 | Berkepeis | |
| 2,738,145 | A | | 3/1956 | Taylor | |
| 2,767,938 | A | | 10/1956 | Taylor | |
| 2,929,569 | A | | 3/1960 | Detrick et al. | |
| 2,943,732 | A | | 7/1960 | Kovaleski et al. | |
| 2,971,709 | A | | 2/1961 | Ellis | |
| 3,061,238 | A | | 10/1962 | Taylor | |
| 3,150,769 | A | | 9/1964 | Cohn | |
| 3,178,130 | A | | 4/1965 | Taylor | |
| 3,589,096 | A | | 6/1971 | Podvin | |
| 3,643,987 | A | | 2/1972 | DuPont | |
| 3,655,140 | A | | 4/1972 | Gordon et al. | |
| 3,666,200 | A | | 5/1972 | Newman et al. | |
| 3,677,490 | A | | 7/1972 | Gordon et al. | |
| 3,677,491 | A | | 7/1972 | Gerwig | |
| 3,747,861 | A | | 7/1973 | Wagner et al. | |
| 3,748,817 | A | | 7/1973 | Newman | |
| 3,812,640 | A | | 5/1974 | Knott | |
| 3,877,653 | A | | 4/1975 | Foltyn et al. | |
| 3,923,270 | A | | 12/1975 | Newman et al. | |
| 3,980,244 | A | | 9/1976 | Pietroni | |
| 3,982,712 | A | * | 9/1976 | Bassett | 242/129 |
| 3,985,315 | A | | 10/1976 | Newman | |
| 4,009,845 | A | | 3/1977 | Santucci et al. | |
| 4,019,636 | A | | 4/1977 | Wise | |
| 4,022,399 | A | | 5/1977 | Zajac | |
| 4,049,120 | A | * | 9/1977 | Bower | 206/396 |
| 4,057,203 | A | | 11/1977 | Newman et al. | |
| 4,057,204 | A | | 11/1977 | Zajac | |
| 4,085,902 | A | | 4/1978 | Wagner | |
| 4,098,467 | A | | 7/1978 | Engmann et al. | |
| 4,140,218 | A | * | 2/1979 | Forte | 206/303 |
| 4,160,533 | A | | 7/1979 | Kotzur et al. | |
| 4,274,607 | A | | 6/1981 | Priest | |
| 4,283,020 | A | | 8/1981 | Bauer et al. | |
| 4,285,157 | A | | 8/1981 | Lambert | |
| 4,313,579 | A | | 2/1982 | Zuber et al. | |
| D267,394 | S | | 12/1982 | Liptak et al. | |
| 4,367,853 | A | | 1/1983 | Kotzur | |
| 4,373,687 | A | | 2/1983 | Zicko | |
| 4,406,419 | A | | 9/1983 | Kotzur | |
| 4,477,033 | A | | 10/1984 | Kotzur et al. | |
| 4,496,049 | A | * | 1/1985 | Pabodie et al. | 206/395 |
| 4,523,723 | A | | 6/1985 | Kotzur | |
| D285,176 | S | | 8/1986 | Kodousek et al. | |
| 4,637,564 | A | | 1/1987 | Hallenback et al. | |
| 4,792,100 | A | | 12/1988 | Pepe | |
| 4,817,796 | A | | 4/1989 | Camillo et al. | |
| 4,884,764 | A | | 12/1989 | Hill | |
| 4,981,255 | A | * | 1/1991 | Schulz | 229/117.22 |
| 5,042,739 | A | | 8/1991 | Zajac | |
| 5,053,795 | A | | 10/1991 | Wyman | |
| 5,115,995 | A | | 5/1992 | Hunt | |
| 5,121,584 | A | | 6/1992 | Suter | |
| 5,150,789 | A | | 9/1992 | Bass | |
| 5,150,852 | A | | 9/1992 | Hunt et al. | |
| 5,203,139 | A | | 4/1993 | Salsburg et al. | |
| D341,777 | S | | 11/1993 | Sheu | |
| D348,392 | S | | 7/1994 | Tannen | |
| 5,368,245 | A | | 11/1994 | Fore | |
| 5,419,009 | A | * | 5/1995 | Assis et al. | 16/407 |
| 5,470,026 | A | | 11/1995 | Kotzur | |
| 5,499,775 | A | | 3/1996 | Vander Groef | |
| 5,520,347 | A | | 5/1996 | Bass et al. | |
| 5,529,186 | A | | 6/1996 | Bass | |
| 5,593,035 | A | | 1/1997 | Taylor et al. | |
| 5,624,528 | A | | 4/1997 | Abrams et al. | |
| 5,642,866 | A | * | 7/1997 | Nieding | 242/588.4 |
| 5,678,778 | A | | 10/1997 | Kotzur et al. | |
| 5,714,936 | A | | 2/1998 | Regelsberger | |
| D396,632 | S | | 8/1998 | Lee | |
| 5,803,394 | A | | 9/1998 | Kotzur et al. | |
| 5,810,272 | A | | 9/1998 | Wallace et al. | |
| D400,096 | S | | 10/1998 | Lee | |
| D406,753 | S | | 3/1999 | Lee | |
| 5,938,260 | A | | 8/1999 | Wallace et al. | |
| 5,941,050 | A | | 8/1999 | Georgetti et al. | |
| 5,979,812 | A | | 11/1999 | Kotzur et al. | |
| 6,003,667 | A | | 12/1999 | Barnett et al. | |
| 6,086,012 | A | | 7/2000 | Kotzur et al. | |
| 6,098,378 | A | | 8/2000 | Wyatt | |
| 6,109,554 | A | | 8/2000 | Kotzur et al. | |
| 6,145,722 | A | | 11/2000 | Behrens et al. | |
| 6,276,623 | B1 | | 8/2001 | Williams | |
| 6,341,741 | B1 | | 1/2002 | Kotzur et al. | |
| 6,491,163 | B1 | | 12/2002 | Grcic et al. | |
| 6,702,213 | B2 | | 3/2004 | Kotzur et al. | |
| 6,766,627 | B2 | | 7/2004 | Kotzur et al. | |
| 7,100,346 | B2 | | 9/2006 | Kotzur et al. | |
| D541,145 | S | | 4/2007 | Copp | |
| 7,249,726 | B2 | | 7/2007 | Kotzur | |
| 7,451,873 | B2 | * | 11/2008 | Chow et al. | 206/395 |
| 7,469,520 | B2 | | 12/2008 | Lancaster, III et al. | |
| 8,191,337 | B2 | | 6/2012 | Moore | |
| 8,251,212 | B2 | * | 8/2012 | Dunlap | 206/403 |
| 8,262,014 | B1 | * | 9/2012 | Selby | 242/588.3 |
| 2002/0174626 | A1 | | 11/2002 | Lancaster, III et al. | |
| 2004/0026284 | A1 | | 2/2004 | Cote | |
| 2006/0219589 | A1 | * | 10/2006 | Shirazi | 206/395 |
| 2007/0272346 | A1 | | 11/2007 | Shpik et al. | |
| 2008/0277523 | A1 | | 11/2008 | Delmore | |
| 2010/0108748 | A1 | | 5/2010 | Fleming et al. | |

OTHER PUBLICATIONS

U.S. Appl. No. 13/506,574; Timothy M. Copp et al, filed Apr. 30, 2012; Apparatus for Dividing Heat-Shrinkable Plastic Film into Different Temperature Regions.

* cited by examiner

FIG. 1
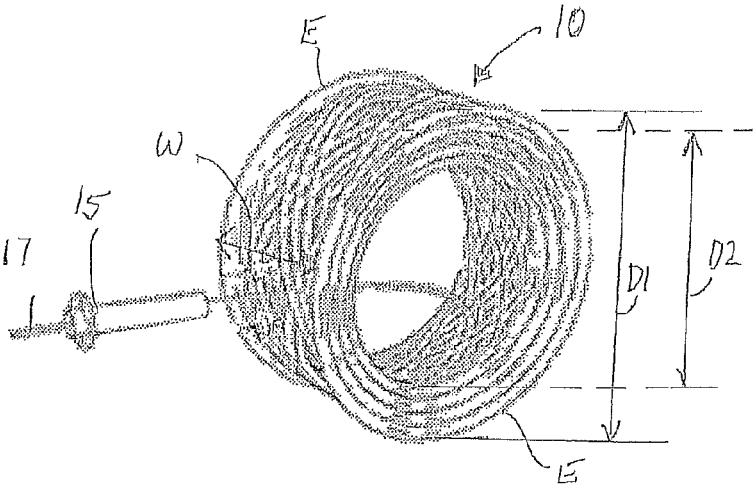
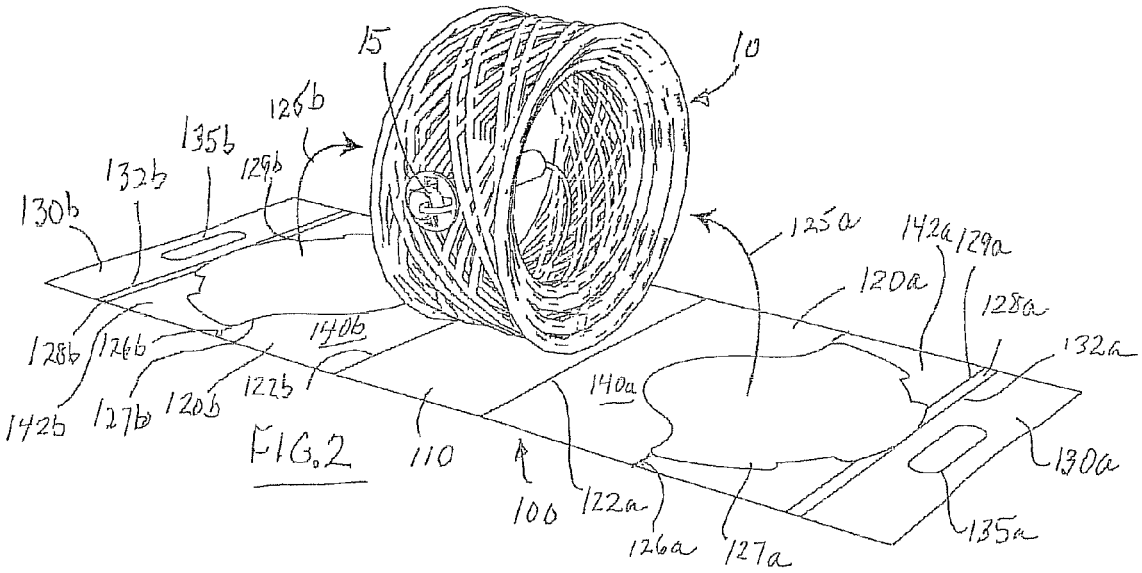
FIG. 2

435b
435c
432b
451
428b
429b
430
453b
10
442a
442b
400
426a
403a
441b
426b
440a
440b
410
453a
402a
403b
453b

PACKAGING FOR WOUND COIL

This is a continuation-in-part of U.S. Ser. No. 13/887,502 entitled "Packaging for Wound Coil" filed on May 6, 2013, which is hereby incorporated by reference herein in its entirety.

BACKGROUND

1. Field

This application relates to packaging for a wound coil. More particularly, this application relates to packaging for a coil of cable, wire, or filaments that is adapted to dispense through a payout tube, although it is not limited thereto. This application also relates to a wound coil in packaging.

2. State of the Art

Coils that dispense from the inside-out without twists, tangles, snags or overruns are known in the art as REELEX-(a trademark of Reelex Packaging Solutions, Inc.) type coils. REELEX-type coils are wound to form a generally short hollow cylinder with the ends of the cylinder extending radially outward beyond the radial extension of the middle of the cylinder, and with a radial opening formed at one location in the middle of the cylinder. A payout tube may be located in the radial opening and the end of the coil may be fed through the payout tube for ease in dispensing the cable, wire, or filaments of the coil.

Because REELEX-type coils do not rotate when unwound, the coil does not depend on the packaging itself to dispense properly. Rather, all that is required is a package that contains a hole generally aligned with the payout tube located in the coil.

One known packaging for REELEX-type coils is a typical six-sided double flap cardboard box, with the box provided with a circular opening in the middle of the double flap side. The cardboard box may also be provided with a hand-hold opening. Another known packaging for REELEX-type coils is a shrink-wrap package with a side opening for the payout tube and an integral top handle having a hand-hold opening.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A packaging particularly useful for a wound coil is provided in the form of a stiff single piece with (i) a central support having a width substantially equal to the width of the coil, (ii) two sides attached to and rotatable relative to the central support, and defining cutouts so that the sides may rotate to extend over a portion of the coil, each side including a portion that meets and can be fastened to a corresponding portion at a location half-way along the width of the coil, and (iii) a handle section attached to the meeting portions of the two sides. The packaging when assembled around the coil presents a bottom support, two sides with openings through which portions of the extremities of the coil extend, two substantially completely open "sides", and a handle. Where the packaging is used with a REELEX-type coil having a payout tube, one of the open sides is aligned with the payout tube.

In one embodiment the handle section of the packaging can assume a first position such that the handle section defines a hand-hold, and is rotatable relative to the meeting portions into a second support position with the handle section being substantially parallel to the central support. In the support position, the handle may be used as a stand to support another packaged coil.

In one embodiment of the packaging the central support and the handle are provided with tabs and/or cut-outs that mate so that the packaging of packaged coils placed one atop another may be locked together.

In one embodiment of the packaging, the sides of the packaging, together with the central support form a triangular configuration. In another embodiment, the sides of the packaging may be flexed along horizontal lines so that the sides of the packaging, together with the central support form a pentagonal shape. The pentagonal shape can include the central support as a bottom, and the side walls arranged with two parallel bottom portions that are perpendicular to the bottom, and two upper portions walls that angle from the parallel walls towards each other and meet above the coil.

According to one aspect, two or more coils and their packaging can be arranged adjacent each other, and placed in a six-sided box for shipping. The six-sided box may include doors or openings aligned with the payout tubes and the open "sides" of the packaging so that the cable, wire, or filament of the coils may be pulled through the box without removing the coils and their packaging from the box.

According to another aspect, multiple coils and their packaging can be arranged adjacent each other and atop each other and placed in a six-sided box for shipping. The six-sided box may include doors or openings spaced horizontally and vertically from each other and aligned with the payout tubes and the open "sides" of the packaging so that the cable wire, or filament of the coils may be pulled through the box without removing the coils and their packaging from the box.

In one embodiment, the packaging is formed from cardboard that is scored in multiple locations. In another embodiment the packaging is formed from a plastic such as polypropylene with live hinges.

The packaging and coil together comprise an assembly.

BRIEF DESCRIPTION OF THE DRAWINGS

FIG. 1 is a perspective view of a REELEX-type coil.

FIG. 2 is a first embodiment of packaging for a coil in an unfolded configuration with a coil located on a central support section of the packaging.

DETAILED DESCRIPTION OF EMBODIMENTS

FIG. 1 is a perspective view of a REELEX-type coil 10. As seen in FIG. 1, a coil 10 of cable, wire, or filament (hereinafter referred to broadly as a "wire") is wound to form a generally short hollow cylinder with the extremities or ends E of the cylinder extending radially outward beyond the radial extension of the middle of the cylinder. In other words, the diameter D1 of the coil at the ends is greater than the diameter D2 of the coil at a location in the middle of the cylinder. The coil is also wound in a manner that provides a radial opening (not shown) for a payout tube 15 (shown uninserted). If the coil 10 is viewed as having a width "w" (i.e., the height of the short cylinder), the payout tube 15 is located along the coil at a position of one-half the width w. The end 17 of the coiled wire may be fed through the payout tube 15 for ease in dispensing the wire.

Figure 3:
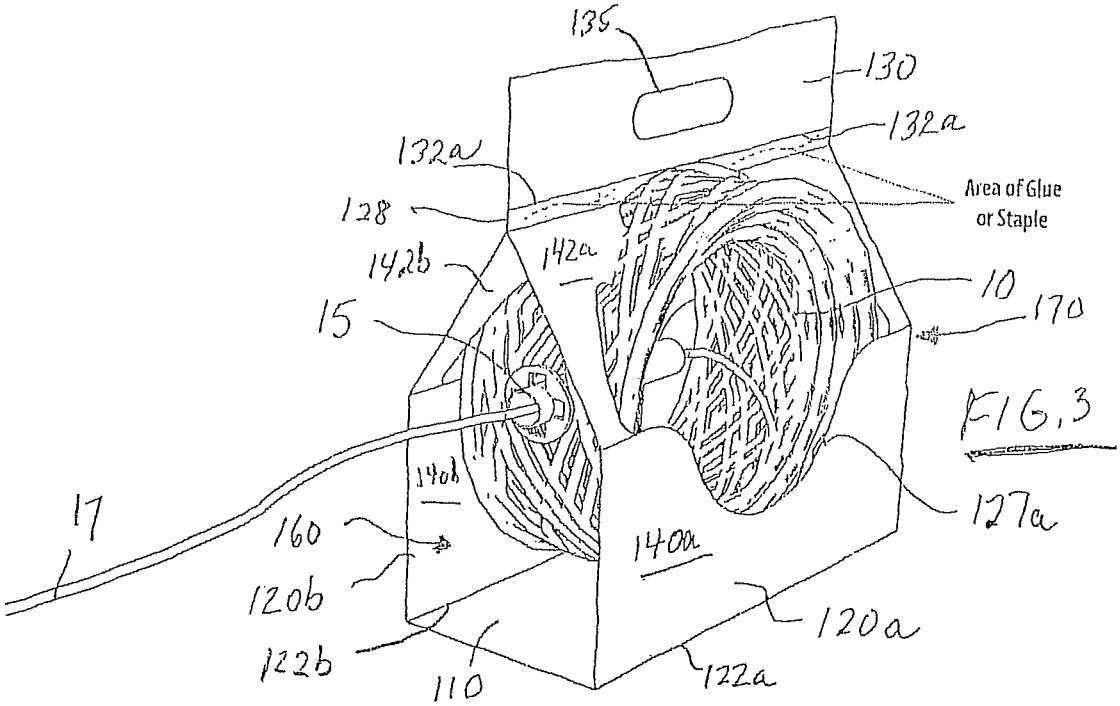
FIG. 3 is a perspective view of the packaging of FIG. 2 with the coil and with the packaging folded up and the handle section in a carrying position.

Turning now to FIGS. 2-6, a packaging 100 particularly useful for a wound coil 10 is provided. The packaging 100 is shown in FIG. 2 in an unfolded form, in FIG. 3 in a folded form intended for transport, in FIGS. 4 and 5 in a folded form intended for dispensing, and in FIG. 6 in a folded form intended for dispensing but in a different position than in FIGS. 4 and 5. As seen best in FIG. 2, the packaging 100 may take the form of a single piece (that may be described as a "stiff sling") with a central support area 110, two sides 120*a*, 120*b*, and a handle section 130. The sides 120*a*, 120*b* are attached to opposite ends of the central support area 110 by creases or live hinges 122*a*, 122*b*, and the handle section 130 is attached to the sides 120*a*, 120*b* by creases or live hinges 132*a*, 132*b*. In one embodiment, the central support area 110 has one dimension a little longer (e.g., less than 30% longer) than the diameter D1 of the ends of the coil cylinder and a width substantially equal (e.g., within 5%) to the width w of the coil. The two sides 120*a*, 120*b* are rotatable (as seen by arrows 125*a*, 125*b*) relative to the central support 110 at the creases 122*a*, 122*b*, and define cutouts 127*a*, 127*b* so that the sides 120*a*, 120*b* may rotate to extend over a portion of the coil 10. Each side 120*a*, 120*b* includes a portion 128*a*, 128*b* that meets and can be fastened (e.g., by glue, staples, or by other attachment means) to a corresponding portion at a location half-way along the width of the coil (as seen best in FIG. 5). The handle 130 is formed from handle sections 130*a*, 130*b* that are attached to and rotatable relative to opposite ends of sides 120*a*, 120*b* by creases or live hinges 132*a*, 132*b*. The handle sections 130*a*, 130*b* define a hand-hold opening 135*a*, 135*b*, which when held together as in FIG. 3 present and define a hand-hold (slot) 135.

Figure 4:
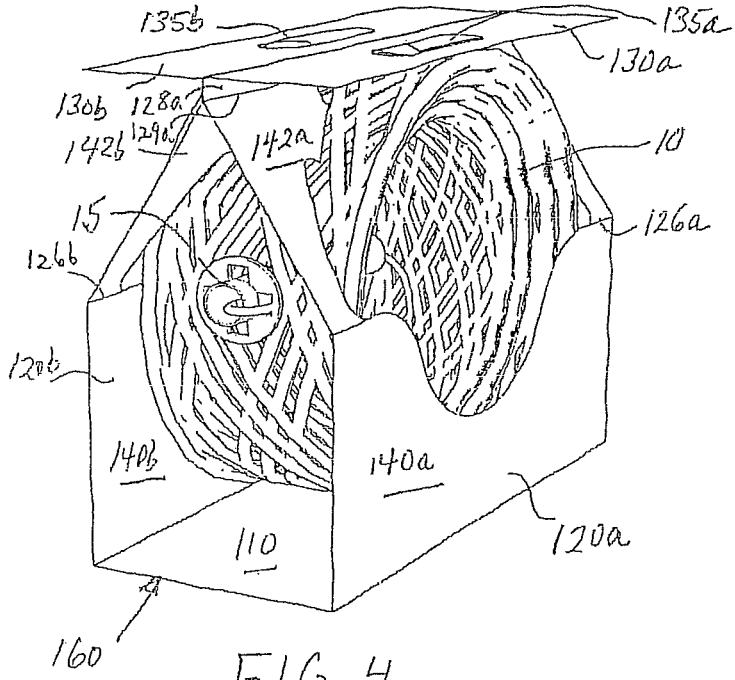
FIG. 4 is a perspective view of the packaging of FIG. 2 with the coil and with the packaging folded up and the handle section in a support position.
Figure 5:
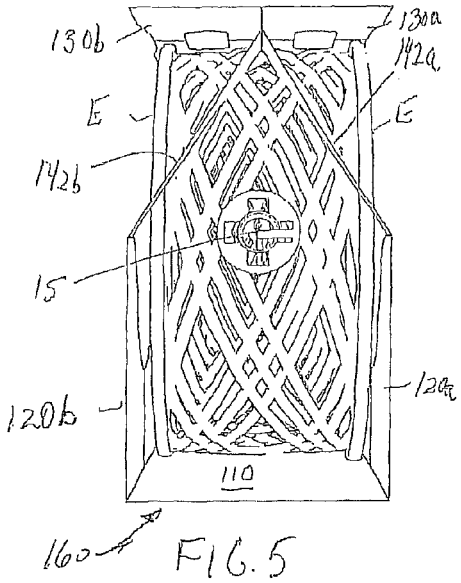
FIG. 5 is an end view of the packaging and coil shown in FIG. 4.

In one embodiment, and as seen in FIGS. 2-6, sides 120*a*, 120*b* of packaging 100 include creases or live hinges 126*a*, 126*b* that extend laterally from the cutouts 127*a*, 127*b* to the edge of the packaging. The creases or live hinges 126*a*, 126*b* permit a first portion 140*a*, 140*b* of each side to extend substantially perpendicular to the central support area 110 and a second portion 142*a*, 142*b* of each side to angle relative to the first portions 140*a*, 140*b* so as to meet at portions 128*a*, 128*b*. Because second portions 142*a*, 142*b* are angled, additional creases or live hinges 129*a*, 129*b* are provided between second portions 142*a*, 142*b* and fastening portions 128*a*, 128*b*. With each sides being provided with two portions, as seen in FIGS. 3-5, the "lower" portion substantially defines a rectangle, and the "upper" portion substantially defines a triangle ("upper" and "lower" being relative terms for when the central support 110 is flush with a support surface). Together, they define an irregular pentagon or a "house-shaped" arrangement.

As suggested above, the cutouts 127*a*, 127*b* are shaped such that when the sides 120*a*, 120*b* are rotated, they extend over a portion of the coil 10. More particularly, in the embodiment of FIGS. 2-6, the sides 120*a*, 120*b* with cutouts 127*a*, 127*b* are arranged so that side portions 140*a*, 140*b* together with central support 110 provides a cradle for the coil 10 and prevents any significant lateral movement, while side portions 142*a*, 142*b* which define a large portion of the cutouts 127*a*, 127*b* extend from just beyond the extremities E of the coil, up and over the coil in a manner that will restrain the vertical movement of the coil.

As seen in FIGS. 3 and 4, the handle 130 of the packaging 100 can assume multiple positions. In a first position (FIG. 3), the handle 130 has handle sections 130*a*, 130*b* aligned vertically so that openings 135*a*, 135*b* together define a hand-hold 135. In a second position (FIG. 4), the handle sections 130*a*, 130*b* are each substantially rotated ninety degrees from the vertical and define a second support position with the handle sections being substantially parallel to the central support 110. In one embodiment, the handle sections 130*a*, 130*b*, when rotated into the support position engage the extremities of the coil 10. Regardless, in the support position, the handle sections 130*a*, 130*b* may be used as a stand to support another packaged coil as described hereinafter with respect to another embodiment.

Figure 6:
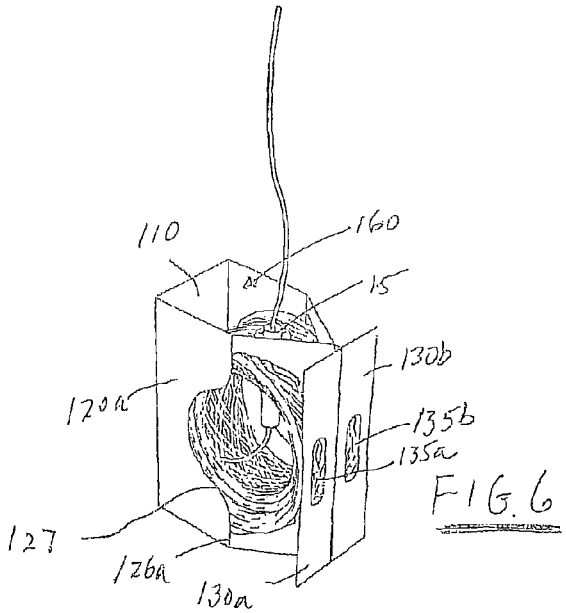
FIG. 6 is a perspective view of the packaging of FIG. 2 with the coil and with the packaging folded up and the handle section in a support position with the packaging and coil assuming a different position than in FIG. 4.

The edges of the central support 110 and the sides 120*a*, 120*b* define open "sides" 160, 170 which are aligned with the payout tube 15. Thus, the cable 10 may be horizontally dispensed through an open side. In addition, and as seen in FIG. 6, the entire packaging 100 with the coil 10 may rotated so that the edges of the sides 120*a*, 120*b*, the central support 110 and the handle sections 130*a*, 130*b* support its positioning with open side 170 on a support surface (not shown). In FIG. 6, the packaging 100 is rotated so that the payout tube 15 is oriented to provide wire upward through open side 160 (vertical dispensing).

In one embodiment, the packaging 100 of FIGS. 2-6 is made from cardboard. The cardboard may be corrugated if desired. In one embodiment, the cardboard is 275# 0.18 inch c-flute cardboard. In one embodiment, the cardboard is scored to provide a live hinge or creased to fold at fold lines 122*a*, 122*b*, 126*a*, 126*b*, 129*a*, 129*b* and 132*a*, 132*b*. In one embodiment the cardboard when laid out flat as in FIG. 2, and adapted for packaging a coil having a height of 5.75 inches and a diameter of 11 inches is substantially a rectangle of approximately 13.65×33.95 inches, with the central support section being approximately 5.75×13.65 inches, the sides up to the attachment or meeting area each being approximately 11.42×13.65 inches, the attachment or meeting area of the sides each being approximately 0.50×13.65 inches, the cut-outs defined by the sides having a widest opening dimension of approximately 11.00 inches, and the handle portions each being approximately 2.675×13.65 inches. Thus, the central support has one dimension substantially equal to the coil width, and another dimension a little larger (compare 13.65 to 11.00) than the coil diameter, and the cut-outs are capable of fitting over the coil.

In one embodiment, the cardboard packaging is sufficiently strong to carry a coil weighing at least 25 pounds. In another embodiment the cardboard packaging is sufficiently strong to carry a coil weighing at least 50 pounds.

In one embodiment, the packaging 100 of FIGS. 2-6 is made from a plastic with live hinges having decreased thicknesses at fold lines 122*a*, 122*b*, 126*a*, 126*b*, 129*a*, 129*b* and 132*a*, 132*b*. The plastic may be polypropylene or any other suitable plastic of suitable strength.

Figure 7:
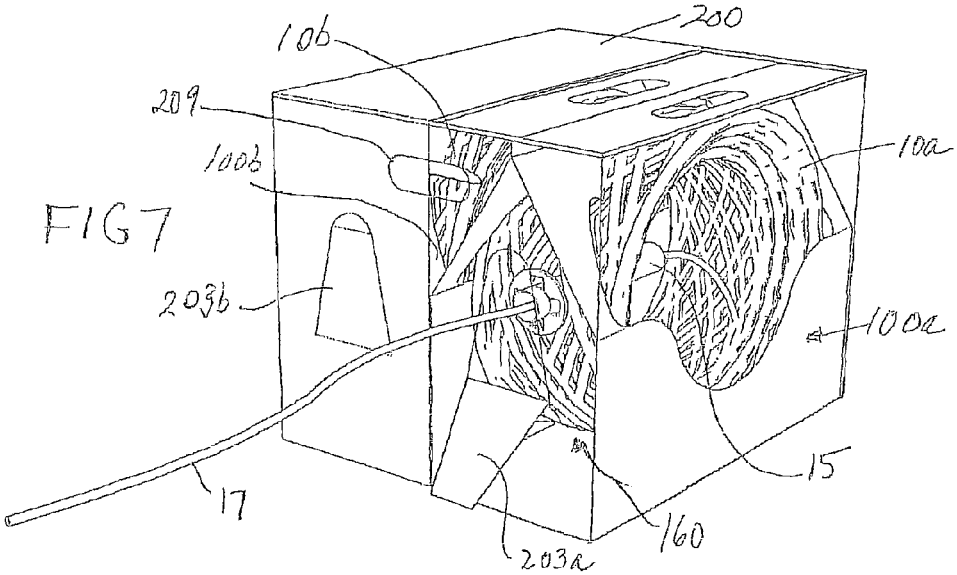
FIG. 7 is a partially transparent view of a shipping box with two coils packaged as in FIG. 4 contained therein.

According to one aspect, and as seen in partially-transparent FIG. 7, two or more coils (two shown—10*a*, 10*b*) and their packaging 100*a*, 100*b* can be arranged adjacent each other, and placed in a six-sided box 200 for shipping. The six-sided box may include doors or openings 203*a*, 203*b* (door 203*a* shown open and door 203*b* shown closed) aligned with the payout tubes 15 and the open "sides" of the packaging 160. In this manner, the cable, wire, or filament 17 of the coils may be pulled easily via the payout tube 15 through the open side 160 of the packaging and through the door of the box 200 without removing the coils and their packaging from the box 200. The box 200 may also be provided with hand-hold openings 209 (only one shown). In one embodiment the hand-hold openings 209 are located on the side of the box containing the doors or openings 203*a*, 203*b*, at a location above and between the doors, and at a similar location on an opposite side of the box.

Figure 8:
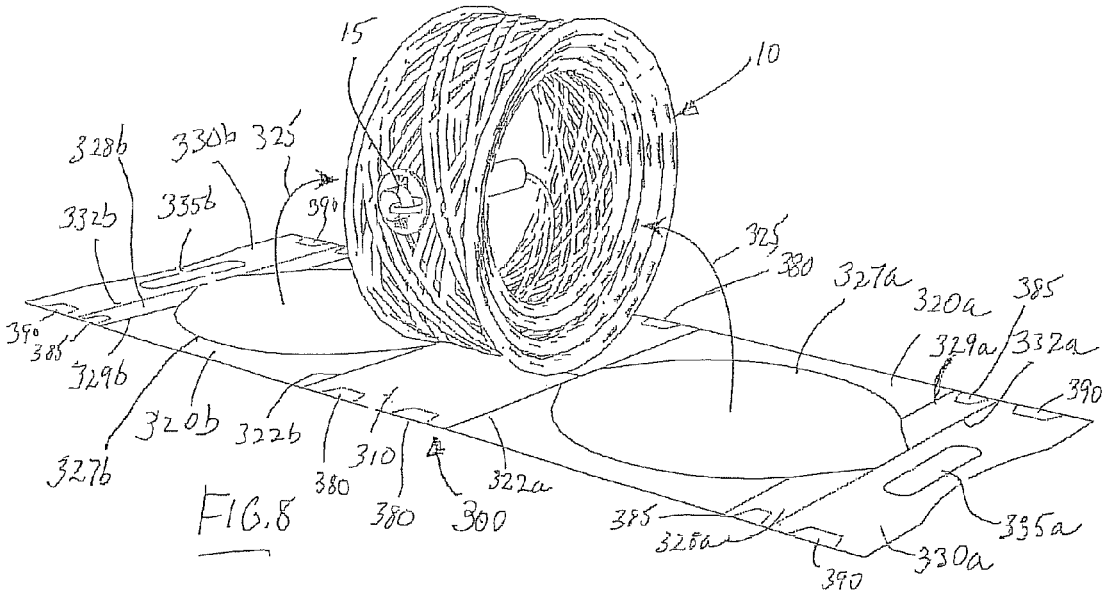
FIG. 8 is a perspective view of a second embodiment of packaging for a coil in an unfolded configuration with a coil located on a central support section of the packaging.
Figure 9:
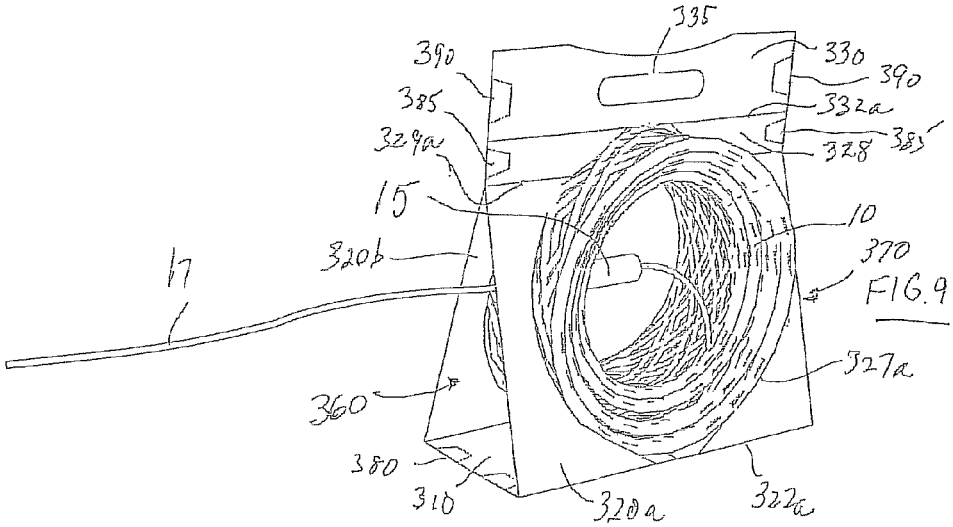
FIG. 9 is a perspective view of the packaging of FIG. 8 with the coil and with the packaging folded up and the handle section in a carrying position.

A second embodiment of packaging for a coil is seen in FIGS. 8-12. The packaging 300 for coil 10 seen in FIGS. 8-12 is similar to the packaging 100 seen in FIGS. 2-6, and like parts are shown with like numbers "200" higher. The packaging 300 is shown in FIG. 8 in an unfolded form, in FIG. 9 in a folded form intended for transport, in FIGS. 10 and 11 in a folded form intended for dispensing, and in FIG. 12 in a folded form intended for dispensing but in a different position than in FIGS. 10 and 11. As seen best in FIG. 8, the packaging 300 may take the form of a single element with a central support area 310, two sides 320*a*, 120*b*, and a handle section 330. The sides 320*a*, 320*b* are attached to opposite ends of the central support area 310 by creases or live hinges 322*a*, 322*b*, and the handle section 330 is attached to the sides 320*a*, 320*b*. The central support area 110 has a length a little longer than the diameter D1 of the ends of the coil cylinder and a width substantially equal to the width w of the coil. The two sides 320*a*, 320*b* are rotatable (as seen by arrows 325*a*, 325*b*) relative to the central support 310 at the creases 322*a*, 322*b*, and define cutouts 327*a*, 327*b* so that the sides 320*a*, 320*b* may rotate to extend over a portion of the coil 10. Each side 320*a*, 320*b* includes a portion 328*a*, 328*b* that meets and can be fastened (e.g., by glue, staples, or by other attachment means) to a corresponding portion at a location half-way along the width of the coil (as seen best in FIG. 11). The handle 330 is formed from handle sections 330*a*, 330*b* that are attached to and rotatable relative to opposite ends of sides 320*a*, 320*b* by creases or live hinges 332*a*, 332*b*. The handle sections 330*a*, 330*b* define a hand-hold opening 335*a*, 335*b*, which when held together as in FIG. 9 present a hand-hold 335.

In one embodiment, and as seen in FIGS. 8-12, when packaging 300 is assembled around coil 10, the sides 320*a*, 320*b* angle toward each other. As a result, in one embodiment, creases or live hinges 329*a*, 329*b* are provided between the main portion of sides 320*a*, 320*b* and the portions of the side that meet and fasten 328*a*, 328*b*. The support area 310 together with sides 320*a*, 320*b* (below fastening portions 328*a*, 328*b*) define a triangle.

As suggested above, the cutouts 327*a*, 327*b* are shaped such that when the sides 320*a*, 320*b* are rotated, they extend over a portion of the coil 10. More particularly, in the embodiment of FIGS. 8-12, the sides 320*a*, 320*b* with cutouts 327*a*, 327*b* are arranged so that a portion of the sides 320*a*, 320*b* near the central support 310, together with central support 310 provides a cradle for the coil 30 and prevents any significant lateral movement, while the remainder of the sides 320*a*, 320*b* which define a large portion of the cutouts 327*a*, 327*b* extend from just beyond the extremities E of the coil, up and over the coil in a manner that will restrain the vertical movement of the coil.

Figure 10:
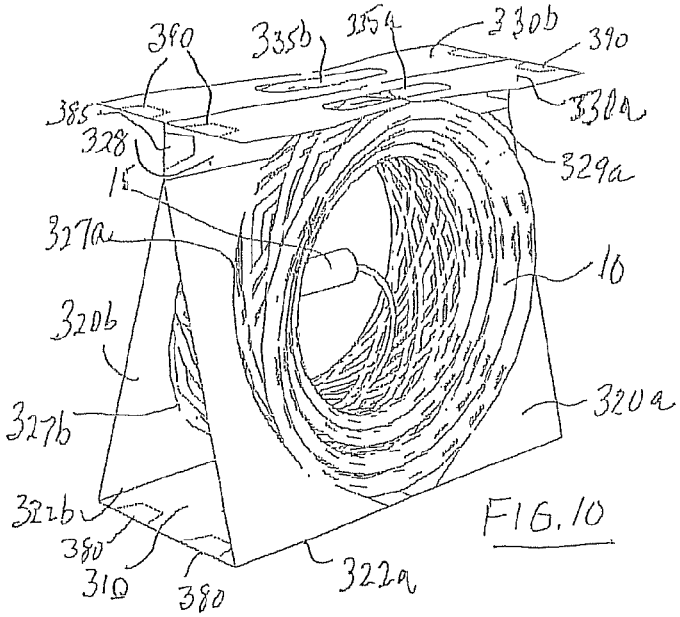
FIG. 10 is a perspective view of the packaging of FIGS. 8 with the coil and with the packaging folded up and the handle section in a support position.
Figure 11:
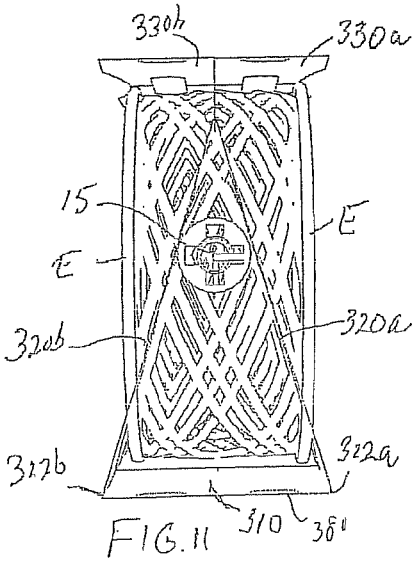
FIG. 11 is an end view of the packaging and coil shown in FIG. 10.

As seen in FIGS. 9 and 10, the handle 330 of the packaging 300 can assume multiple positions. In a first position (FIG. 9), the handle 330 has handle sections 330*a*, 330*b* aligned vertically so that openings 335*a*, 335*b* together define a hand-hold 335. In a second position (FIG. 10), the handle sections 330*a*, 330*b* are each substantially rotated ninety degrees from the vertical and define a second support position with the handle sections being substantially parallel to the central support 310. In one embodiment, the handle sections 330*a*, 330*b*, when rotated into the support position engage the extremities of the coil 10. Regardless, in the support position, the handle sections 330*a*, 330*b* may be used as a stand to support another packaged coil as described hereinafter with respect to FIG. 14.

Figure 12:
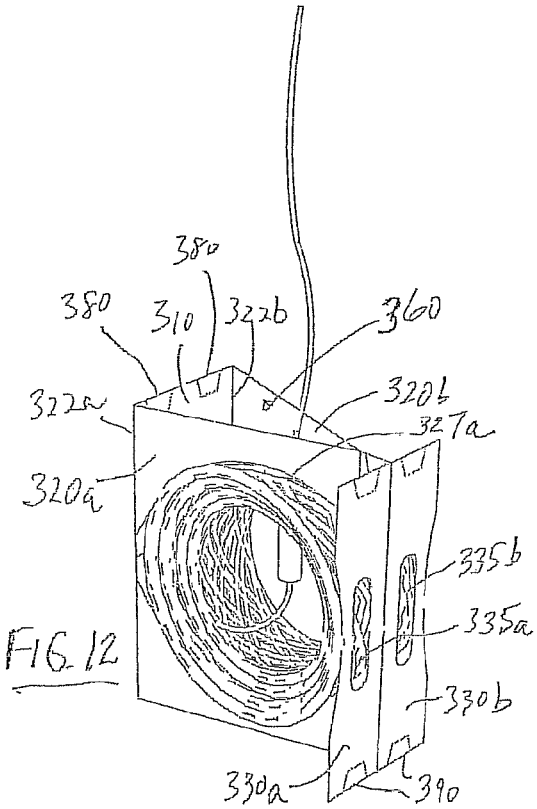
FIG. 12 is perspective view of the packaging of FIG. 8 with the coil and with the packaging folded up and the handle section in a support position with the packaging and coil assuming a different position than in FIG. 10.

The edges of the central support 310 and the sides 320*a*, 320*b* define open "sides" 360, 370 which are aligned with the payout tube 15. Thus, the cable 10 may be horizontally dispensed through an open side. In addition, and as seen in FIG. 12, the entire packaging 300 with the coil 10 may rotated so that the edges of the sides 320*a*, 320*b*, the central support 310 and the handle sections 330*a*, 330*b* support its positioning with open side 370 on a support surface (not shown). In FIG. 12, the packaging 300 is rotated so that the payout tube 15 is oriented to provide wire upward through open side 360 (vertical dispensing).

Packaging 300 is also optionally provided with a plurality of tabs, fastening elements or fastening means 380, 385, 390. Two sets of tabs 380 (total of four) are shown located at opposite edges of the support section 310. Similarly, (four) tabs 385 are shown located at opposite edges of fastening sections 328*a*, 328*b* of sides 320*a*, 320*b*. Also, (four) tabs 390 are shown located at opposite edges of the handle portions 330*a*, 330*b*. As is explained hereinafter with reference to FIG. 14, tabs 380 and 390 are provided so that tabs 380 of one packaging unit can interlock with the tabs 390 of another packaging unit, while tabs 385 are provided to permit manual interlocking of fastening sections 328*a*, 328*b* together.

In one embodiment, the packaging 300 of FIGS. 8-12 is made from cardboard. The cardboard may be corrugated if desired. In one embodiment, the cardboard is 0.18 inch c-flute cardboard. In one embodiment, the cardboard is scored to provide a live hinge or creased to fold at live hinge or fold lines 322*a*, 322*b*, 329*a*, 329*b* and 332*a*, 332*b*. The cardboard may also be scored or cut through at each tab 380, 385, 390.

The cardboard may be of a similar size as the cardboard described above with reference to the embodiment of FIGS. 2-6, although it will typically be slightly wider for the same size coil in order to permit the cut-out on the sides to extend over the coil. The cardboard may also be of a similar weight-bearing capacity.

In one embodiment, the packaging 300 of FIGS. 8-12 is made from a plastic with live hinges of decreased thicknesses at fold lines 322*a*, 322*b*, 329*a*, 329*b* and 332*a*, 332*b*. The plastic may also be scored or cut through at each tab 380, 385, 390. The plastic may be polypropylene or any other suitable plastic of suitable strength.

Figure 13:
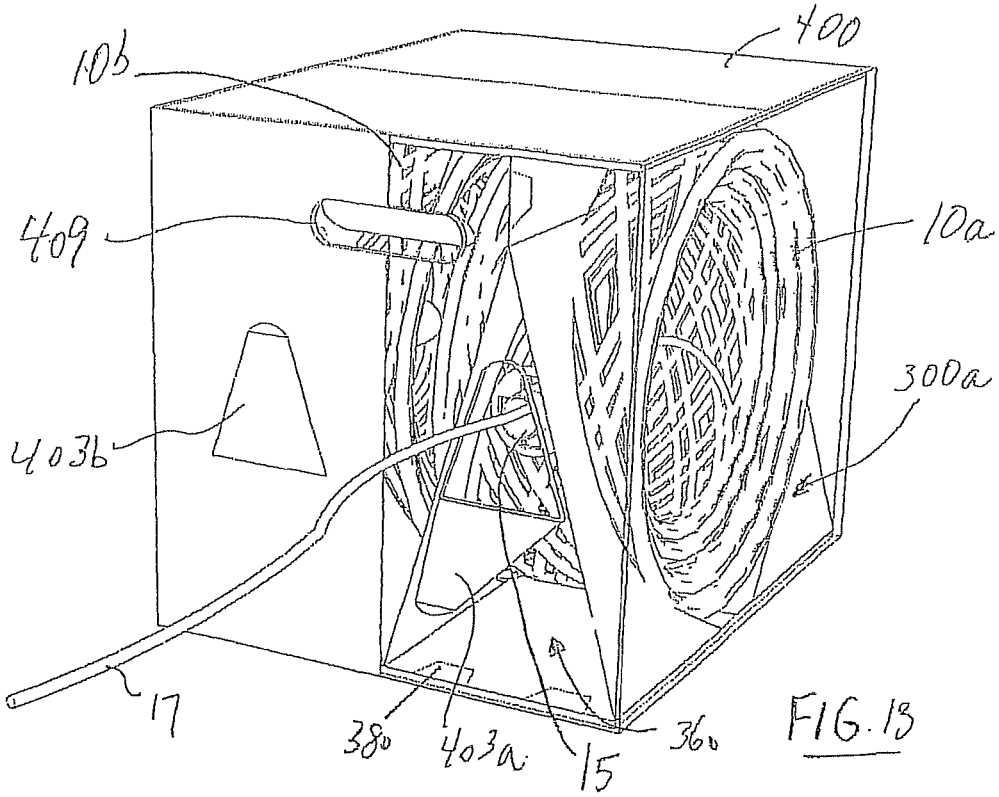
FIG. 13 is a partially transparent view of a shipping box with two coils packaged as in FIG. 10 contained therein.

According to one aspect, and as seen in partially-transparent FIG. 13, two or more coils (two shown—10*a*, 10*b*) and their packaging 300*a*, 300*b* can be arranged adjacent each other, and placed in a six-sided box 400 for shipping. The six-sided box may include doors or openings 403*a*, 403*b* (door 403*a* shown open and door 403*b* shown closed) aligned with the payout tubes 15 and the open "sides" of the packaging 360. In this manner, the cable, wire, or filament 17 of the coils may be pulled easily via the payout tube 15 through the open side 360 of the packaging and through the door of the box 400 without removing the coils and their packaging from the box 400. The box 400 may also be provided with hand-hold openings 409 (only one shown). In one embodiment the hand-hold openings 409 are located on the side of the box containing the doors or openings 403*a*, 403*b*, at a location above and between the doors, and at a similar location on an opposite side of the box.

Figure 14:
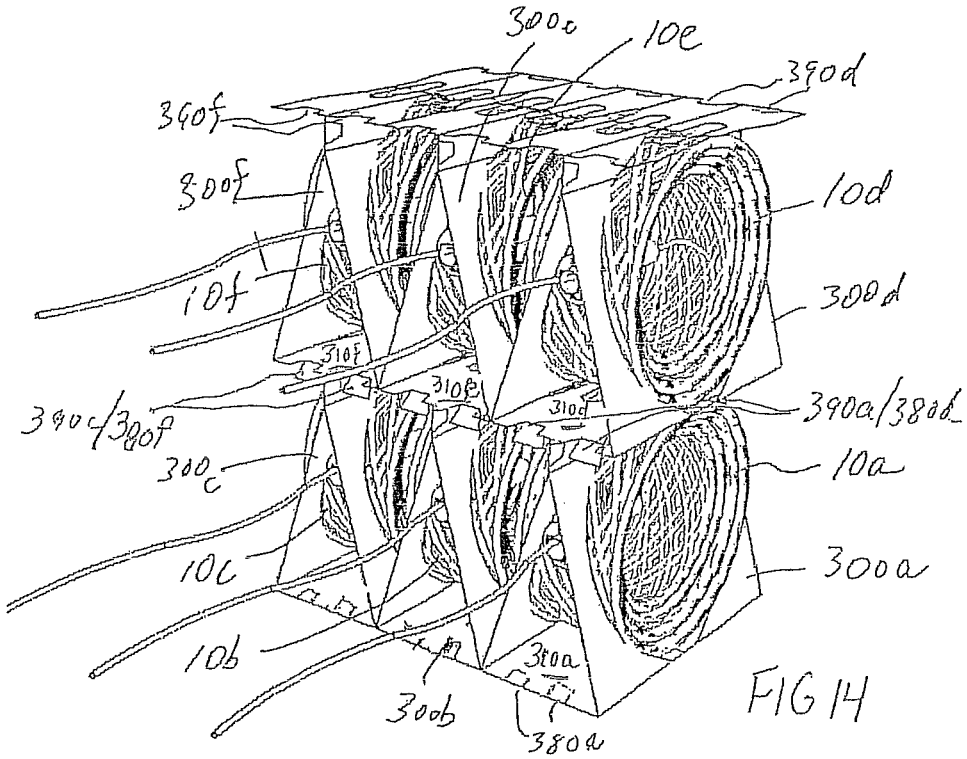
FIG. 14 is a perspective view of six coils as packaged as in FIG. 10 with three packages located atop of another three and with interlocking tabs.

Turning now to FIG. 14, six coils 10*a*-10*f* arranged in packaging 300*a*-300*f* are seen, with packaging 300*a*-300*c* arranged adjacent each other (packaging 300*b* in the middle), and packaging 300*d*-300*f* arranged adjacent each other (packaging 300*e* in the middle) and atop packaging 300*a*-300*c*. More specifically, the support sections 310*d*-310*f* of packaging 300*c*-300*f* are resting atop the handle sections of packaging 310*a*-310*c*. In one embodiment, the tabs 380*d*-380*f* of the support sections 310*d*-310*f* of packaging 300*d*-300*f* are engaging (e.g., locking) the tabs 390*a*-390*c* of the handle sections of packaging 310*a*-310*c*, thereby providing additional stability to the arrangement.

According to another aspect, the six packaged coils shown in FIG. 14 can be placed in a six-sided box for shipping. One side of the six-sided box may include six doors or openings spaced horizontally and vertically from each other and aligned with the payout tubes and the open "sides" of the packaging so that the cable wire, or filament of the coils may be pulled through the box without removing the coils and their packaging from the box.

Figure 15:
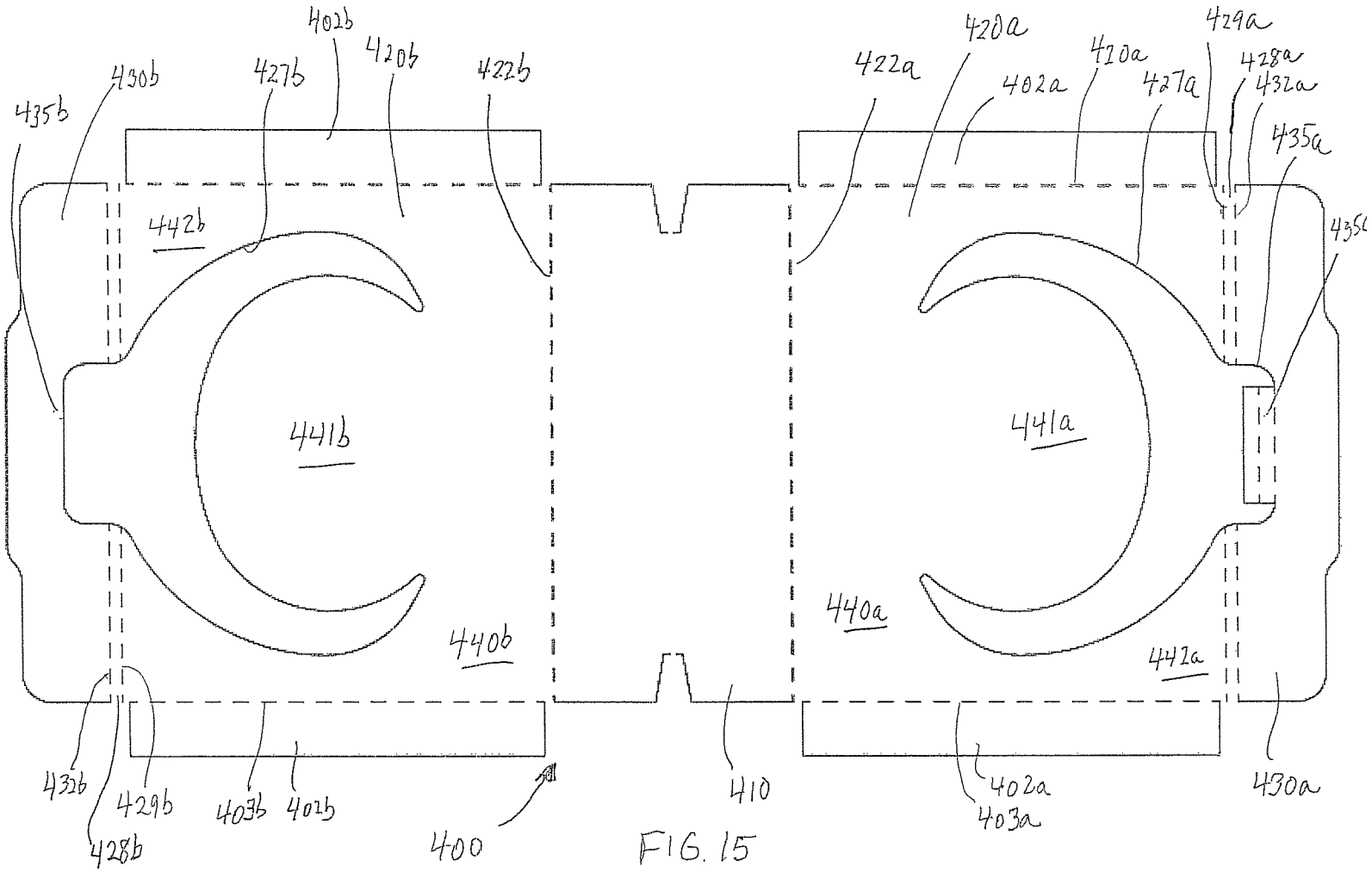
FIG. 15 is a view of a third embodiment of packaging for a coil in an unfolded configuration.
Figure 16:
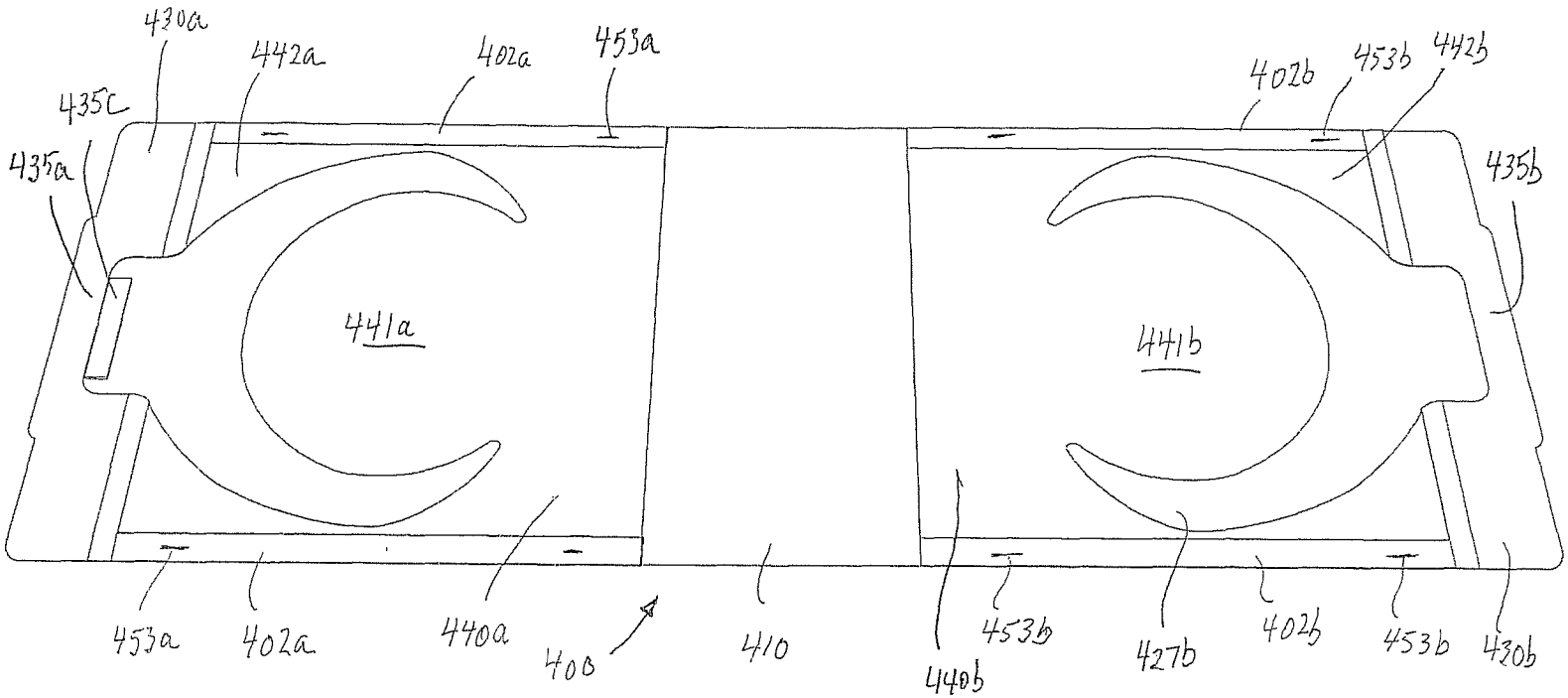
FIG. 16 is a (rotated) view of the embodiment of FIG. 15 with tab reinforcement sections folded and secured.
Figure 17:
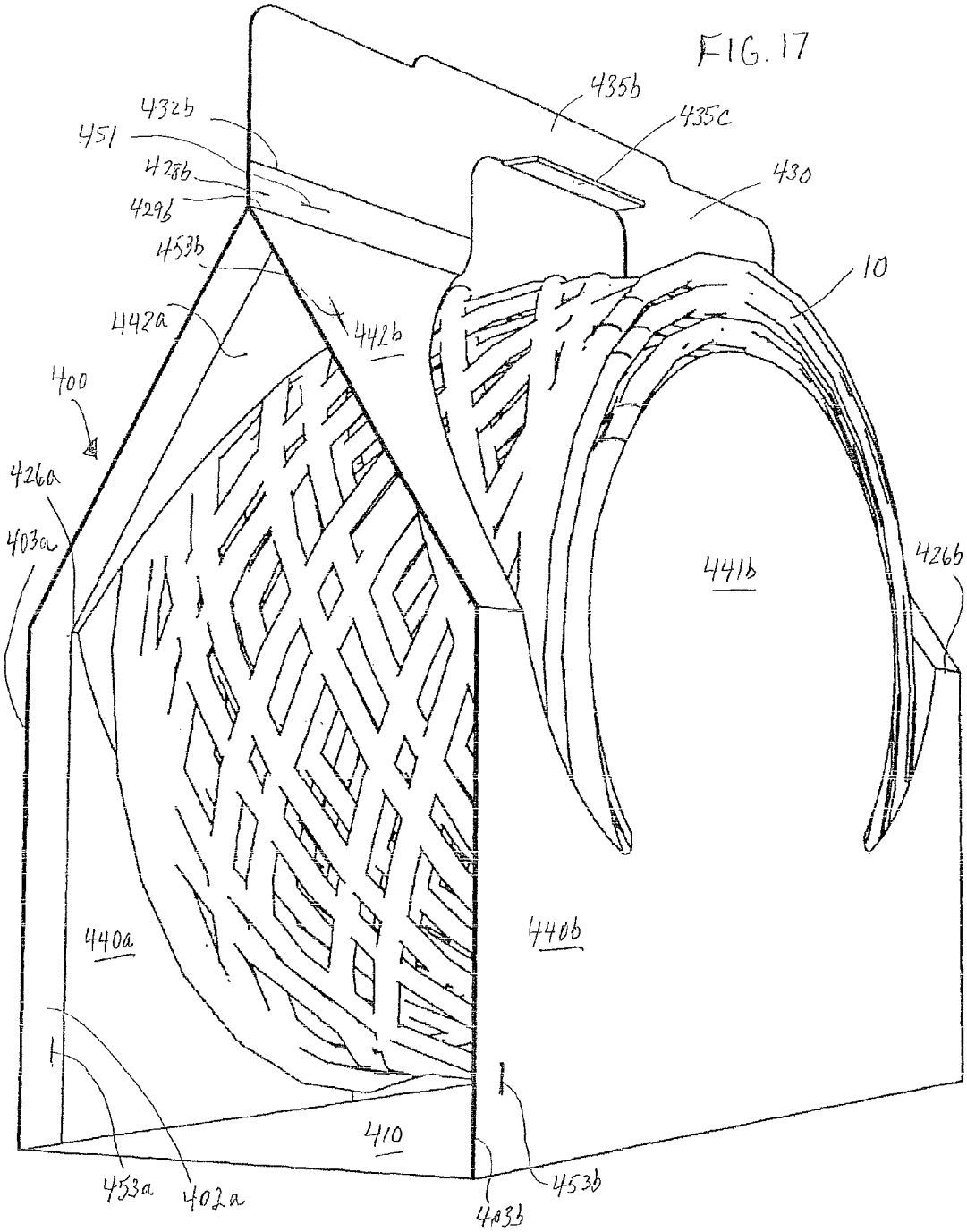
FIG. 17 is a perspective view of the embodiment of FIGS. 15 and 16 holding a coil with the packaging folded and the handle section in a carrying position.

A third embodiment of packaging for a coil is seen in FIGS. 15-17. The packaging 400 for coil 10 seen in FIGS. 15-17 is similar to the packaging 100 seen in FIGS. 2-6, and like parts are shown with like numbers "300" higher. The packaging 400 is shown in FIG. 15 in an unfolded form, in FIG. 16 in a partially folded form where reinforcement flaps 402*a*, 402*b* are folded and secured, and in FIG. 17 in a folded form (with coil 10) intended for transport. As seen best in FIG. 15, the packaging 400 may take the form of a single piece (that may be described as a "stiff sling") with a central support area 410, two sides 420*a*, 420*b*, and a handle section 430 (FIG. 17). The sides 420*a*, 420*b* are attached to opposite ends of the central support area 410 by creases or live hinges 422*a*, 422*b*, and the handle section 430 is attached to the sides 420*a*, 420*b* by creases or live hinges 432*a*, 432*b*. In one embodiment, the central support area 410 has one dimension a little longer (e.g., less than 30% longer) than the diameter of the ends of the coil cylinder and a width substantially equal (e.g., within 5%) to the width of the coil. The two sides 420*a*, 420*b* are rotatable relative to the central support 410 at the creases 422*a*, 422*b*, and define cutouts 427*a*, 427*b* (with internal or central flaps 441*a*, 441*b*) so that the sides 420*a*, 420*b* may rotate to extend over a portion of the coil 10. Each side 420*a*, 420*b* includes a portion 428*a*, 428*b* that meets and can be fastened (e.g., by glue, staples, or by other attachment means) to a corresponding portion at a location half-way along the width of the coil (as seen best in FIG. 17 where a staple 451 is shown). The handle 430 is formed from handle sections 430*a*, 430*b* that are attached to and rotatable relative to opposite ends of sides 420*a*, 420*b* by creases or live hinges 432*a*, 432*b*. The handle sections 430*a*, 430*b* define a hand-hold opening 435*a*, 435*b*, which when held together as in FIG. 3 present and define a hand-hold (slot) 435. A flap 435*c* is shown extending from handle section 430*a* into opening 435*a* and may be used for ease of handling and reinforcement when gripping the handle 430 (as seen best in FIG. 17).

Additional flaps 402*a*, 402*b* are shown provided on the edges of sides 420*a*, 420*b*. Flaps 402*a*, 402*b* when folded along fold lines 403*a*, 403*b* and secured (as seen in FIGS. 16 and 17) act as reinforcement for the side sections 440*a*, 440*b*, 442*a*, 442*b* which are "weight-bearing" when the coil is transported by the handle 430. The flaps 402*a*, 402*b* may be secured in any manner such as by gluing, stapling (as shown with staples 453*a*, 453*b*), or other attachment means.

In one embodiment, and as seen in FIG. 17, sides 420*a*, 420*b* of packaging 400 include creases or live hinges 426*a*, 426*b* (see FIG. 17) that extend laterally from the cutouts 427*a*, 427*b* to the edge of the packaging. The creases or live hinges 426*a*, 426*b* permit a first portion 440*a*, 440*b* of each side to extend substantially perpendicular to the central support area 410 and a second portion 442*a*, 442*b* of each side to angle relative to the first portions 440*a*, 440*b* so as to meet at portions 428*a*, 428*b*. Because second portions 442*a*, 442*b* are angled, additional creases or live hinges 429*a*, 429*b* are provided between second portions 442*a*, 442*b* and fastening portions 428*a*, 428*b*. With each sides being provided with two portions, as seen in FIG. 17, the "lower" portion substantially defines a rectangle, and the "upper" portion substantially defines a triangle ("upper" and "lower" being relative terms for when the central support 410 is flush with a support surface). Together, they define an irregular pentagon or a "house-shaped" arrangement.

As suggested above, the cutouts 427*a*, 427*b* are shaped such that when the sides 420*a*, 420*b* are rotated, they extend over a portion of the coil 10. More particularly, in the embodiment of FIGS. 15-17, the sides 420*a*, 420*b* with cutouts 427*a*, 427*b* are arranged so that reinforced side portions 440*a*, 440*b* and central flaps 441*a*, 441*b* together with central support 410 provides a cradle for the coil 10 and prevents any significant lateral movement, while side portions 442*a*, 442*b* which define a large portion of the cutouts 427*a*, 427*b* extend from just beyond the extremities of the coil, up and over the coil in a manner that will restrain the vertical movement of the coil. It will be appreciated that central flaps 441*a*, 441*b* also provide a large surface for printing trademark (source) information and advertising.

The handle 430 of the packaging 400 can assume multiple positions. In a first position (FIG. 17), the handle 430 has handle sections 430*a*, 430*b* aligned vertically so that openings 435*a*, 435*b* together define a hand-hold 435 with flap 435 protecting the edges of the opening. In a second position (not shown), the handle sections 430*a*, 430*b* are each substantially rotated ninety degrees from the vertical and define a second support position with the handle sections being substantially parallel to the central support 410.

The edges of the central support 410 and the (flap-folded) sides 420*a*, 420*b* define open "sides" 460, 470 which are aligned with the payout tube of the coil (not shown). Thus, the cable 10 may be horizontally dispensed through an open side. In addition, the entire packaging 400 with the coil 10 may rotated so that the flap-folded edges of the sides 420*a*, 420*b*, the central support 410 and the handle sections 430*a*, 430*b* support its positioning with open side 470 on a support surface (not shown).

The packaging 400 of FIGS. 15-17 can be made from cardboard. The cardboard may be corrugated if desired. In one embodiment, the cardboard is 275#0.19 inch c-flute cardboard. In one embodiment, the cardboard is scored to provide a live hinge or creased to fold at fold lines 403*a*, 403*b*, 422*a*, 422*b*, 426*a*, 426*b*, 429*a*, 429*b* and 432*a*, 432*b*. In one embodiment the cardboard when laid out flat as in FIG. 15, and adapted for packaging a coil having a height of 5.75 inches and a diameter of 11 inches is substantially a rectangle of approximately 13.65×34.82 inches (not including flaps 402*a*, 402*b* which are each approximately 1.415 inches wide by approximately 11.11 inches long), with the central support section being approximately 5.75×13.65 inches, the sides up to the attachment or meeting area each being approximately 11.42×13.65 inches, the attachment or meeting area of the sides each being approximately 0.50×13.65 inches, the cut-outs defined by the sides having a widest opening dimension of approximately 11.00 inches, and the handle portions each being approximately 2.675×13.65 inches. Thus, the central support has one dimension substantially equal to the coil width, and another dimension a little larger (compare 13.65 to 11.00) than the coil diameter, and the cut-outs are capable of fitting over the coil.

In one embodiment, the packaging for the coils is symmetric relative to a line bisecting the central support section. In another embodiment, the packaging for the coils is symmetric relative to a line bisecting the central support section, the sides, and the handle sections. In another embodiment, the packaging for the coils is symmetric both relative to a line bisecting the central support section and a perpendicular line bisecting the central support section, the sides, and the handle sections.

It will be appreciated that the packaging embodiments have various beneficial aspects. In one aspect, the packaging allows for the coil to be oriented in multiple axes without the coil falling over or rolling. This provides a stable orientation for the payout of the cable. In another aspect, the packaging provides a stable platform for shipping by preventing the cylindrical coil from rotating during transport. In a further aspect, the packaging provides surfaces that may be printed on for marketing purposes. In yet another aspect, the packaging is inexpensive to manufacture but strong, and enables a user of the coil to easily transport and handle the coil.

There have been described and illustrated herein several embodiments of a packaging for a coil, and a packaged coil. While particular embodiments of the invention have been described, it is not intended that the invention be limited thereto, as it is intended that the invention be as broad in scope as the art will allow and that the specification be read likewise. Thus, while particular materials, dimensions, and capacities for the packaging have been disclosed, it will be appreciated that other materials, dimensions and capacities may be used as well. In addition, while tabs, fastening elements or fastening means were disclosed for one embodiment and not another, it will be understood that different aspects of one embodiment can be used in conjunction with another embodiment. Further, while the central support element was described as having a length a little longer (e.g., 30% longer) than the diameter D1 of the ends of the coil cylinder, it will be appreciated the packaging may be cut down at the central support element if desired, to provide a central support element that is not as long as diameter D1, although that will result in a packaging die that is not regular in shape. Also, the corners of the rectangular packaging may be rounded. Also, while packaging was described as being formed from a single piece, it will be appreciated that it could be formed from multiple pieces that are attached together. For purposes herein, pieces that are attached together can be considered to be a single piece. Further yet, while the packaging has been described with particular reference to a REELEX-type coil, it will be understood that the packaging is useful for other types of coils. It will therefore be appreciated by those skilled in the art that yet other modifications could be made to the provided invention without deviating from its spirit and scope as claimed. In the claims, means-plus-function clauses, if any, are intended to cover the structures described herein as performing the recited function and not only structural equivalents, but also equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. Packaging for a wound coil having an outer wound coil diameter and a wound coil width, the packaging comprising:

a substantially rectangular piece of material foldable along a plurality of parallel lines to form (i) a central support having a width substantially equal to the width of the coil, (ii) first and second side elements attached to and rotatable relative to said central support, and defining cutouts so that said side elements may rotate to extend over a portion of the wound coil, said first side element including a first meeting portion, and said second side element including a second meeting portion, said first and second meeting portions being fastened to each other at a location substantially half-way along the width of the coil, and (iii) a handle section with a first handle portion and a second handle portion, said first handle portion attached and rotatable relative to said first meeting portion and said second handle portion attached and rotatable relative to said second meeting portion, said first handle portion and said second handle portion together assuming a first position where said handle section defines a hand-hold substantially perpendicular to said central support, wherein when folded, said central support and said first and second side elements define two parallel substantially open sides each in an irregular pentagonal configuration.

2. Packaging according to claim 1, wherein:

said first and second side elements each include a plurality of reinforcement flaps which are foldable along lines perpendicular to said plurality of parallel lines, said plurality of reinforcement flaps secured to said first and second side elements.

3. Packaging according to claim 1, wherein:

said first and second side elements include central flaps around which said cutouts extend.

4. Packaging according to claim 3, wherein:

said central support, said central flaps and said first and second side elements form a cradle for the wound coil.

5. Packaging according to claim 1, wherein:

said material is cardboard, and said plurality of parallel lines include first fold lines and second fold lines, wherein said first and second side elements are attached to said central support at said first fold lines in said cardboard, and said two portions of said handle section are attached to said first and second meeting portions at said second fold lines in said cardboard.

6. Packaging according to claim 5, wherein:

said plurality of parallel lines include third fold lines, and said meeting portions of said two sides are defined by said third fold lines in said first and second side elements.

7. Packaging according to claim 6, wherein:

said first and second side elements each include a plurality of reinforcement flaps which are foldable along lines perpendicular to said plurality of parallel lines, said plurality of reinforcement flaps secured to said first and second side elements.

8. Packaging according to claim 7, wherein:

said first and second side elements include central flaps around which said cutouts extend.

9. Packaging according to claim 8, wherein:

said central support, said central flaps and said first and second side elements form a cradle for the wound coil.

10. A packaging and wound coil assembly, comprising:

a wound coil having an outer wound coil diameter and a wound coil width, said wound coil being wound as a short hollow generally cylindrical coil and provided with a payout tube having a longitudinal axis extending laterally from said cylindrical coil; and a packaging extending around said first wound coil, said packaging formed from a generally rectangular single piece of cardboard and comprising (i) a central support having a width substantially equal to the width of the coil, (ii) first and second side elements attached to and rotatable along first parallel lines relative to said central support, and defining cutouts so that said side elements may rotate to extend over a portion of wound coil, said first side element including a first meeting portion, and said second side element including a second meeting portion, said first and second meeting portions being fastened to each other at a location substantially halfway along the width of the coil, and (iii) a handle section with a first handle portion and a second handle portion, said first handle portion attached and rotatable relative to said first meeting portion and said second handle portion attached and rotatable relative to said second meeting portion, said first handle portion and said second handle portion together assuming a first position where said handle section defines a hand-hold, wherein said coil is cradled by said central support and first and second side elements and is substantially prevented from lateral and vertical movement in said packaging, and said central support and first and second side elements define two open sides aligned with said longitudinal axis of said payout tube and in an irregular pentagonal configuration.

11. A packaging and wound coil assembly according to claim 10, wherein:

said first and second side elements each include a plurality of reinforcement flaps which are foldable along lines perpendicular to said first parallel lines, said plurality of reinforcement flaps secured to said first and second side elements.

12. A packaging and wound coil assembly according to claim 10, wherein:

said first and second side elements include central flaps around which said cutouts extend, said central flaps further cradling said coil.

* * * * *